US006016865A

United States Patent [19]

Blomgren

[11] Patent Number: 6,016,865

[45] Date of Patent: Jan. 25, 2000

[54] PLATE HEAT EXCHANGER

[75] Inventor: Ralf Blomgren, Skanör, Sweden

[73] Assignee: Alfa Laval AB, Lund, Sweden

[21] Appl. No.: 09/171,301

[22] PCT Filed: Apr. 16, 1997

[86] PCT No.: PCT/SE97/00641

§ 371 Date: Oct. 15, 1998

§ 102(e) Date: Oct. 15, 1998

[87] PCT Pub. No.: WO97/39301

PCT Pub. Date: Oct. 23, 1997

[30] Foreign Application Priority Data

Apr. 16, 1996 [SE] Sweden ..... 9601438

[51] Int. Cl.[7] ..... F28D 1/03

[52] U.S. Cl. ..... 165/148; 165/167; 165/906

[58] Field of Search ..... 165/166, 167, 165/906, 148, 153

[56] References Cited

U.S. PATENT DOCUMENTS

| | | | |
|---|---|---|---|
| 2,610,835 | 9/1952 | Hytte | 165/167 |
| 3,931,854 | 1/1976 | Ivanhnenko et al. | 165/166 |
| 4,911,235 | 3/1990 | Andersson et al. | 165/167 |
| 5,050,671 | 9/1991 | Fletcher | 165/148 X |

FOREIGN PATENT DOCUMENTS

| | | | |
|---|---|---|---|
| 139388 | 5/1992 | Japan | 165/167 |
| 127 970 | 4/1950 | Sweden . | |
| 320 678 | 2/1970 | Sweden . | |
| 622 608 | 4/1981 | Switzerland . | |
| 1071116 | 6/1967 | United Kingdom . | |

*Primary Examiner*—Leonard Leo
*Attorney, Agent, or Firm*—Fish & Richardson P.C.

[57] ABSTRACT

In a plate heat exchanger the heat transfer plates (7, 8) are in pairs welded together to form cassettes (6). The two plates in every cassette bear on each other via corrugation ridges (25), which are crossing each other and create a flow path (33) between them for a first fluid. The cassettes (6) bear on each other via elevations (26), which are higher than the corrugation ridges (22) on the outsides of the cassettes. Between the cassettes (6) flow paths (34) are delimited for a second fluid. The main directions of flow for the two fluids are in parallel. Each one of the mentioned elevations (26) is elongated and extends with its longitudinal axis substantially in parallel with the main directions of flow for the fluids, bridging at most two valleys (23) between corrugation ridges (22) extending next to each other.

8 Claims, 4 Drawing Sheets

Fig. 3
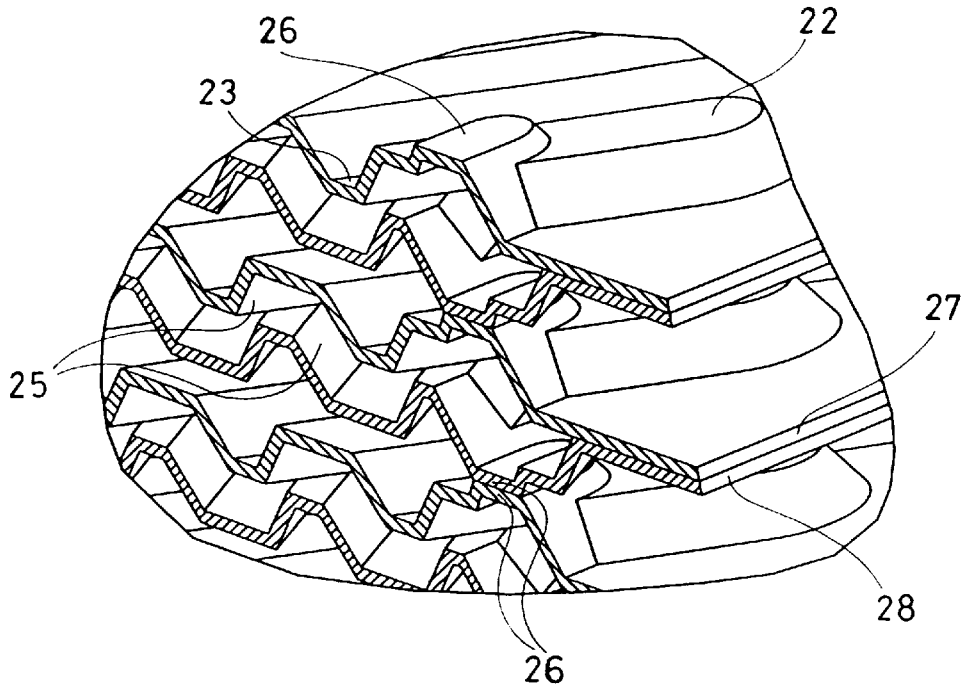
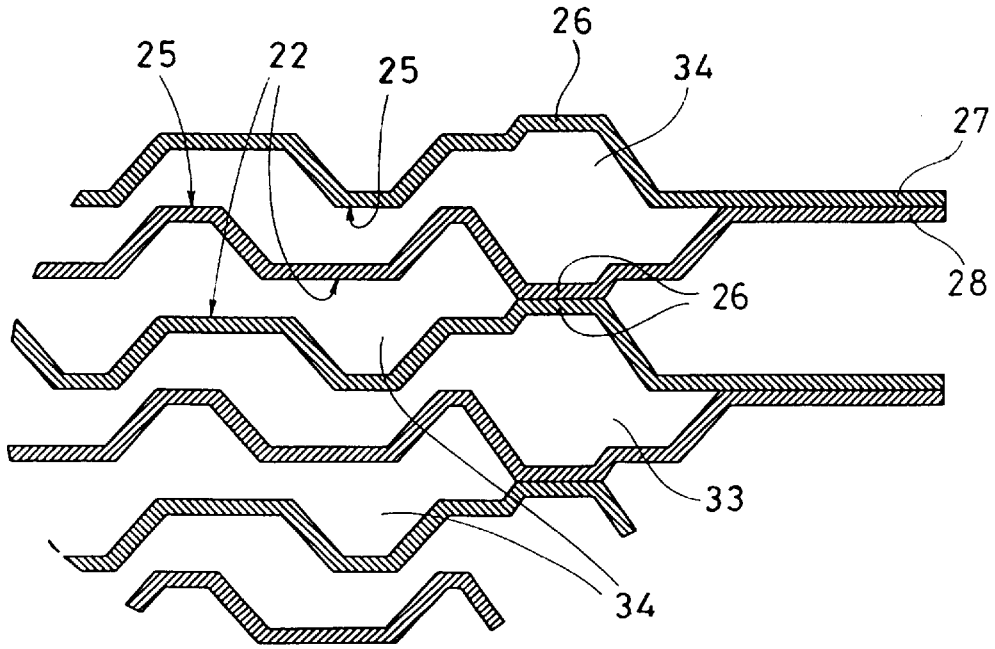
Fig. 4

PLATE HEAT EXCHANGER

FIELD OF THE INVENTION

This invention concerns a plate heat exchanger at which a plurality of plates are so arranged as to create plate interspaces between them for flowing through of two fluids; inlets and outlets for the mentioned fluids are so arranged that a first one of the fluids is led through every other plate interspace and a second one of the fluids is led through the rest of the plate interspaces in main directions of flow, which are in parallel with each other; each plate is provided with a press pattern which is such that the plate on its both sides shows ridges and valleys extending next to each other, which form an angle with the mentioned main directions of flow; ridges of the mentioned kind in a crossing manner bear on ridges of the same kind in those of the mentioned plate interspaces, which are created for flowing through of said mentioned first fluid; every other plate has, on that one of its sides, which is turned to a plate interspace created for flowing through of the mentioned second fluid, elevations created by pressing of the plate, which elevations are higher than those ridges that are on the same side of the plate; and the mentioned elevations at every other plate bear on the adjacent plate in the mentioned plate interspace, which is created for flowing through of the mentioned second fluid, in such a way that opposite ridges at the two plates are kept at a distance from each other. By the design of the plates in this manner the fact is achieved that the mentioned second fluid meets a considerably lower flow resistance than the mentioned first fluid at the flowing of the fluids through the plate heat exchanger.

BACKGROUND OF THE INVENTION

In GB-1,071,116 a plate heat exchanger of this kind is shown, at which special elevations are designed for keeping the plates at a distance from each other in every other plate interspace meant for flowing through of a gaseous fluid, which distance is larger than the distance between the plates in the rest of the plate interspaces aimed for the flowing through of a fluid in a liquid state. The special elevations are created on the tops of those ridges that are crossing each other in the plate interspaces for the gaseous fluid.

SUMMARY OF THE INVENTION

The object of this invention is to create a plate heat exchanger of the kind mentioned by way of introduction, at which heat exchanger the plates are designed so as to be utilized more effectively than what is the case with the known heat exchanger according to GB-1,071,116 for the desired heat transfer between the fluids.

This object can, according to the invention, be achieved by each one of the mentioned elevations on every other plate being elongated and extending, with its longitudinal axis, substantially in parallel with the mentioned main directions of flow, thereby bridging at the most two valleys between ridges extending next to each other, which ridges are created on the same side of the plate as the elevation in question.

By such an arrangement for the mentioned elevations these can be given any wanted height without any need to forego the present desire concerning the design of the ridges and valleys extending next to each other. Thus, it is desirable at—and by—the pressing of the mentioned ridges and valleys in a plate to create the largest possible area enlargement of the plate, so that the plate may be used to a maximum for the present heat transfer.

At a plate which is designed in accordance with GB-1, 071,116 (the FIGS. 5 and 6) the largest possible area enlargement of the plate is decided by the local area enlargement that is created in the areas for the extra elevations on the top of the mentioned ridges. Thus if a maximum area enlargement is created in the areas for the extra elevations, this means that the ridges as for the rest are created with a somewhat smaller area enlargement than that one at a maximum for the plate.

At a plate designed in accordance with the invention the same maximum area enlargement can be achieved in the areas for the mentioned ridges as in the areas for the elevations. Accordingly, the top of each one of the mentioned ridges may, as seen in the form of a cross-section through the ridge, be given the same radius of curvature as the top of an elongated elevation according to the invention, as seen in a cross-section through the elevation. By the fact that every elevation is extending substantially in parallel with the main direction of flow for the mentioned second fluid the elevation can be designed so as to occupy a very small part of the flow area for the mentioned second fluid. In order for the elevations of the plates to be made as narrow as possible it is convenient for all plates in the plate heat exchanger to be provided with such elevations and that the elevations of one plate bear on the elevations of an adjacent plate. This is especially important when the plates are elongated and have its longitudinal axis extending in parallel with the main directions of flow for the heat exchanging fluids, since in this case the flow areas for the two fluids between the plates are relatively constricted. The heat exchange is normally aimed to take place in counter flow for heat exchanging fluids but alternatively following flow for the fluids may occur.

As mentioned above each one of the mentioned elevations bridges at the most two valleys situated between ridges extending next to each other. Preferably, however, every elevation only bridges one valley between two adjacent ridges. The reason for this is that every elevation of this kind which is created on one side of a plate creates a recess in the plate on the other side of this plate. This recess will constitute an unwanted flow passage for the mentioned first fluid across a ridge formed on this other side of the plate. An important condition for the plate heat exchanger according to the invention to be as effective as possible is that such unwanted flow passages for the mentioned first fluid are as short as possible.

The present invention can be utilized in connection with any type of plate heat exchanger. Accordingly it can be used no matter which means are used for delimiting the flow paths for the heat exchanging fluids between the plates. Such means may for example be exchangeable gaskets of elastic material or permanent weld or braze seams between the plates.

The invention is especially well suited for so called brazed plate heat exchangers, at which adjacent plates are—at least in every other plate interspace—brazed together in all places where the plates are in contact with each other, i.e. not only along the edges of the plates but also—and above all—at a plurality of places distributed over the substantial heat transfer areas of the plates.

At such a plate heat exchanger according to the invention the plates are preferably brazed together in those plate interspaces that shall be flown through by the mentioned first fluid. In those plate interspaces a lot of connection places are created in this manner where the ridges of the respective plates in a crossing manner bear on each other. Hereby the mentioned first fluid may be allowed to have a considerably higher pressure than the mentioned second fluid without this relationship calling for special demands concerning the design of the mentioned elevations in the plate interspaces for the mentioned second fluid that shows a relatively low pressure. The reason is that these elevations need not transfer any forces between the plates which are dependent upon the high pressure with which the mentioned first fluid shall flow through the plate heat exchanger and they may for this reason be very few in number. This means that the elevations may occupy the smallest possible area of the present flow area for the mentioned second fluid.

It has been stressed above that, for a certain reason, each one of the mentioned elevations should bridge only one of those valleys that are created between the ridges in the plate interspaces for the mentioned second fluid. This is important also for another reason. The design of elevations of the mentioned kind may get into conflict with a wish that as many as possible and as evenly distributed contact and connection places as possible will be achieved between the present plates in the plate interspaces for the mentioned first fluid. The shorter the elevations are made the smaller the risk for such a conflict will be or, alternatively, the smaller the negative consequences of such a conflict will be if this is not to be avoided.

BRIEF DESCRIPTION OF THE DRAWINGS

The invention will be described in the following in connection with the accompanying drawing, in which FIG. 3 shows an enlargement of a part B of FIG. 2, FIG. 4 shows a cross-section through some heat transfer plates, that are also shown in FIG. 3, FIGS. 5*a* and *b* show two heat transfer plates, FIGS. 6*a, b* and *c* show a plan view and two sections of a part C of the heat transfer plate of FIG. 5*b*, respectively.

DETAILED DESCRIPTION

Figure 1:
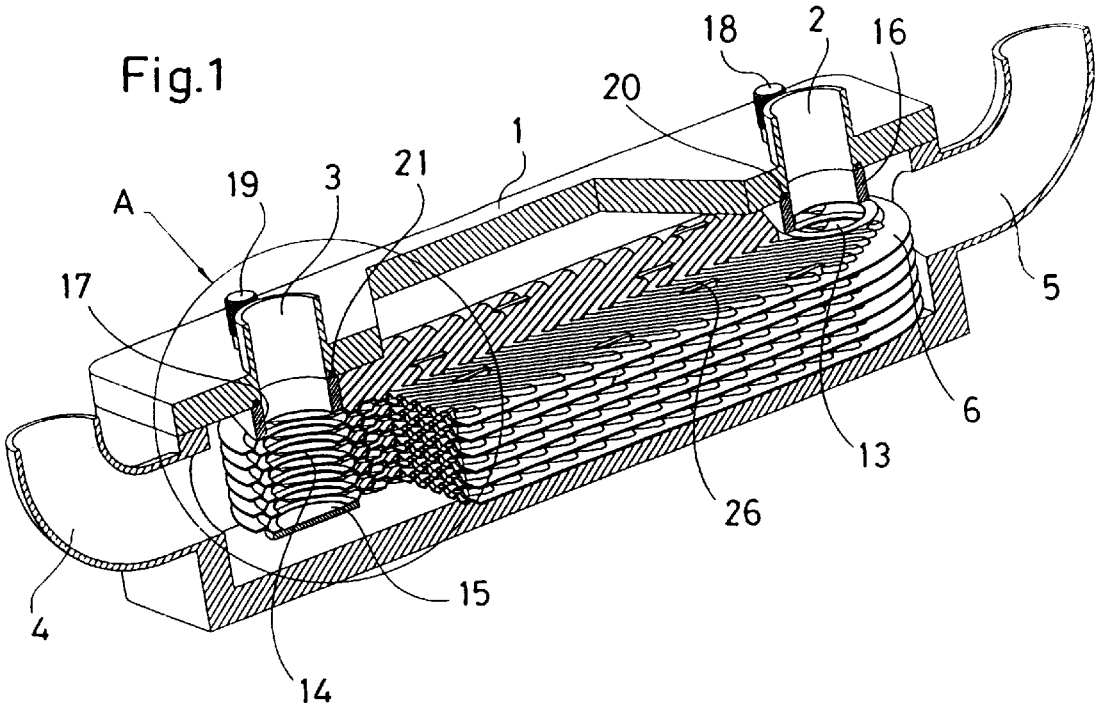
FIG. 1 shows a plate heat exchanger according to the invention, partly in section.

In the drawing a plate heat exchanger is shown that is specially aimed for a heat exchange between a relatively small flow of oil and a relatively large flow of water. In this actual case the oil is of a relatively high pressure, while the water is of a relatively low pressure. Further on the oil shall in this case be chilled with the aid of the water.

As is evident from the FIG. 1 the plate heat exchanger incorporates a housing 1, which has an inlet 2 and an outlet 3 for the oil and an inlet 4 and an outlet 5 for the water. Inside the housing 1 a pile of cassettes 6 is placed, each cassette consisting of two elongated heat transfer plates 7 and 8 (see FIG. 5).

The two plates 7,8 in every cassette 6 are welded together along their circumferential edges and delimit between them a flow path for oil which shall be chilled within the plate heat exchanger. The plates 7,8 have got through holes 9–12 at their ends, which holes are situated in line with the inlet 2 and the outlet 3, respectively, for the oil. Adjacent cassettes 6 are welded together with each other around the holes 9–12, respectively, so that the holes constitute an inlet channel 13 and an outlet channel 14, respectively, extending through the whole pile of cassettes 6.

Figure 2:
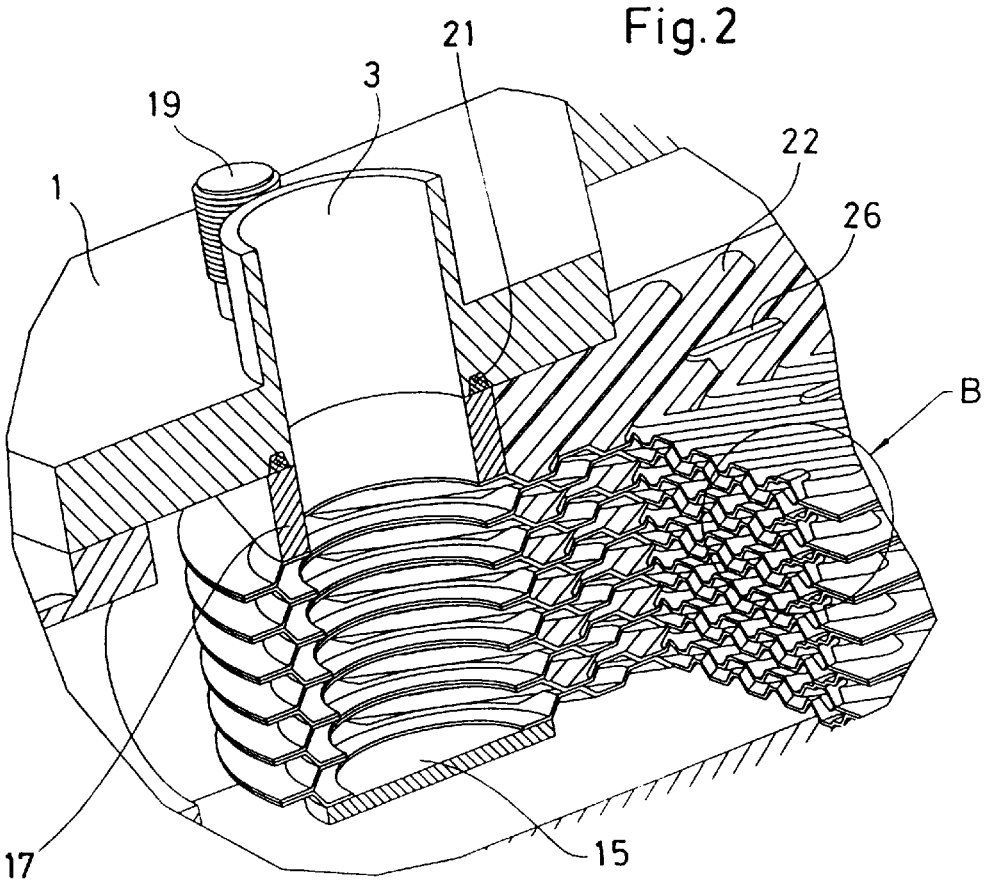
FIG. 2 shows an enlargement of a part A of FIG. 1.

As is evident from the FIGS. 1 and 2 a circular washer 15 is arranged right before the outlet channel 14 below the lowermost cassette 6, so that it covers the hole through the lowermost plate in this cassette 6. The washer 15 is sealingly brazed at the lowermost plate and around the mentioned hole. In a corresponding manner a washer (not shown) is arranged right before the inlet channel 13 underneath the lowermost cassette 6.

Between the uppermost cassette 6 and an upper wall of the housing 1 a connection piece 16 is arranged showing a through hole, which is coaxial with the oil inlet 2 of the housing and with the inlet channel 13 of the cassette pile. In a corresponding manner a similar connection piece 17 is arranged at the oil outlet 3 of the housing 1.

The connection pieces 16 and 17, that are brazed at the uppermost cassette 6, each one has two threaded pin bolts 18 and 19, respectively, (FIG. 7), which extend out through holes in the upper wall of the housing 1 (FIG. 1). The pile of cassettes may be fixed in relation to the housing 1 by nuts (not shown), that shall be threaded upon the pin bolts 18 and 19, by being pressed towards the inside of the upper wall of the housing 1. Gaskets 20 and 21 are arranged to seal between the housing 1 and the connection pieces 16 and 17, respectively, around the oil inlets and outlets 2 and 3.

In every cassette the plates are situated at a distance from each other in annular areas around the holes 9–12, respectively. This is best shown in FIG. 2. Thus oil may enter through the inlet 2 and the inlet channel 13, be distributed and flow through all plate interspaces within the cassettes 6 and leave the plate heat exchanger via the outlet channel 14 and the outlet 3.

Water may enter through the inlet 4, flow through compartments constituted between adjacent cassettes 6 and leave the plate heat exchanger through the outlet 5.

The oil and the water accordingly flow through the pile of cassettes 6 in a counterstream along main flow paths that are substantially in parallel with each other.

Figure 5:
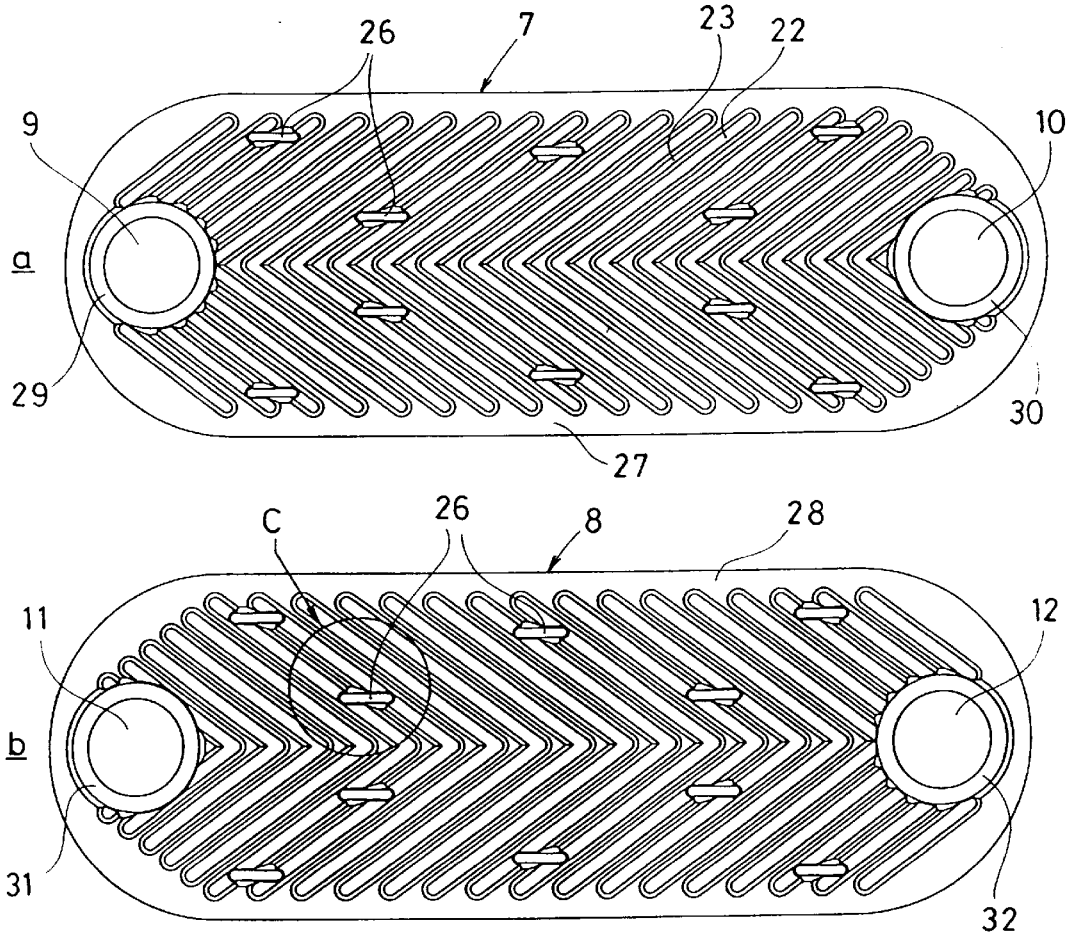

In FIGS. 5*a* and *b* two plates 7 and 8, respectively, of thin plate are shown, that may be brazed together to form a cassette 6. The plates 7 and 8 are identically designed and in FIG. 5 one of them is shown turned 180° in its own plane in relation to the other one.

Figure 6:
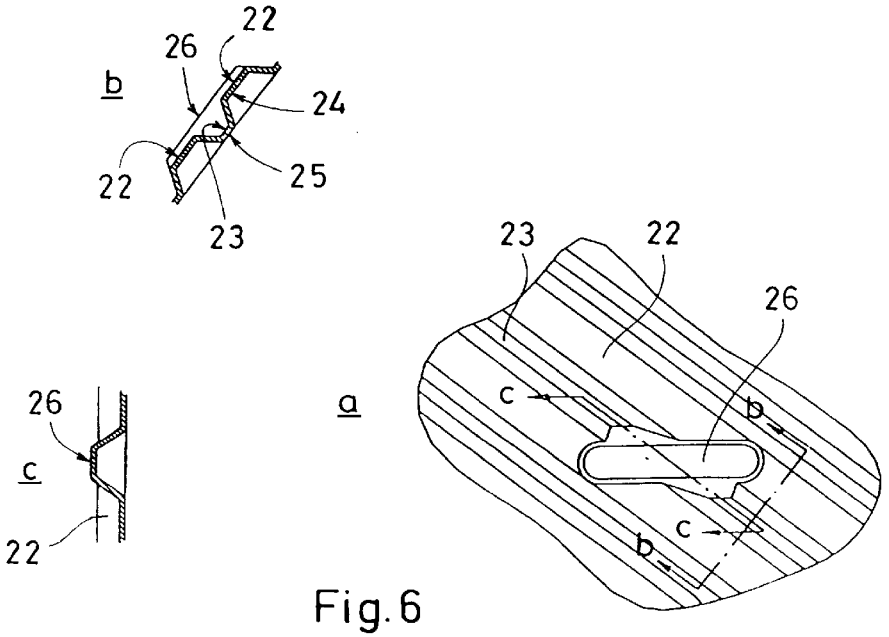

Each one of the plates is provided with a press pattern of corrugations comprising ridges and valleys in parallel. On one side of the plate (see FIG. 5*a* ) ridges 22 and valleys 23 are created. As shown in FIG. 6*b* the ridges 22 constitute valleys 24 on the other side of the plate. In a corresponding manner the valleys 23 on one side of the plate,constitute ridges 25 on the other side of the plate. The ridges and the valleys are pressed in a so called herringbone pattern so that when a plate 7 is placed on a plate 8, as these plates are oriented in the FIG. 5, the ridges and the valleys of the plates will cross each other.

Besides the press pattern with ridges and valleys each one of the plates 7 and 8 has got elongated pressed elevations 26. These elevations extend in the longitudinal direction of the plates and are somewhat higher than the ridges 22. Each one of the elevations 26 extends from the top of a ridge 22 to the top of an adjacent ridge 22, bridging the valley 23 in between. This is best seen in the FIGS. 6*a–c*, where the FIGS. 6*b* and *c* are cross-sections through a plate taken along the lines b—b and c—c, respectively, in the FIG. 6*a*.

The plates 7 and 8 in FIG. 5 have edge parts 27, 28 extending circumferentially around the respective plates.

These edge parts are present in the same plane as the tops of the ridges 25 (see FIG. 4). In other words the ridges 22 and the elevations 26 start from this plane.

Around their through holes 9–12 the plates in the FIG. 5 have annular areas 29–32, which all are situated in a plane that extends through the tops of the elevations 26.

At the creation of a cassette 6 the plates 7 and 8 are laid against each other with those of their respective sides that are not visible in FIGS. 5*a* and *b*. Hereby the edge parts 27,28 of the plates will get into contact with each other, whereby the ridges 25 on the one plate will bear on the ridges 25 on the other plate in a crossing manner as is obvious from the FIG. 3.

By piling of a plurality of cassettes upon each other the annular areas 29–32 and the elevations 26 at one cassette will bear on similar annular areas and elevations at adjacent cassettes in the constructed pile. This is seen from the FIGS. 2–4. Every elevation 26 will thus bear on a similar elevation 26 along its entire length.

Figure 7:
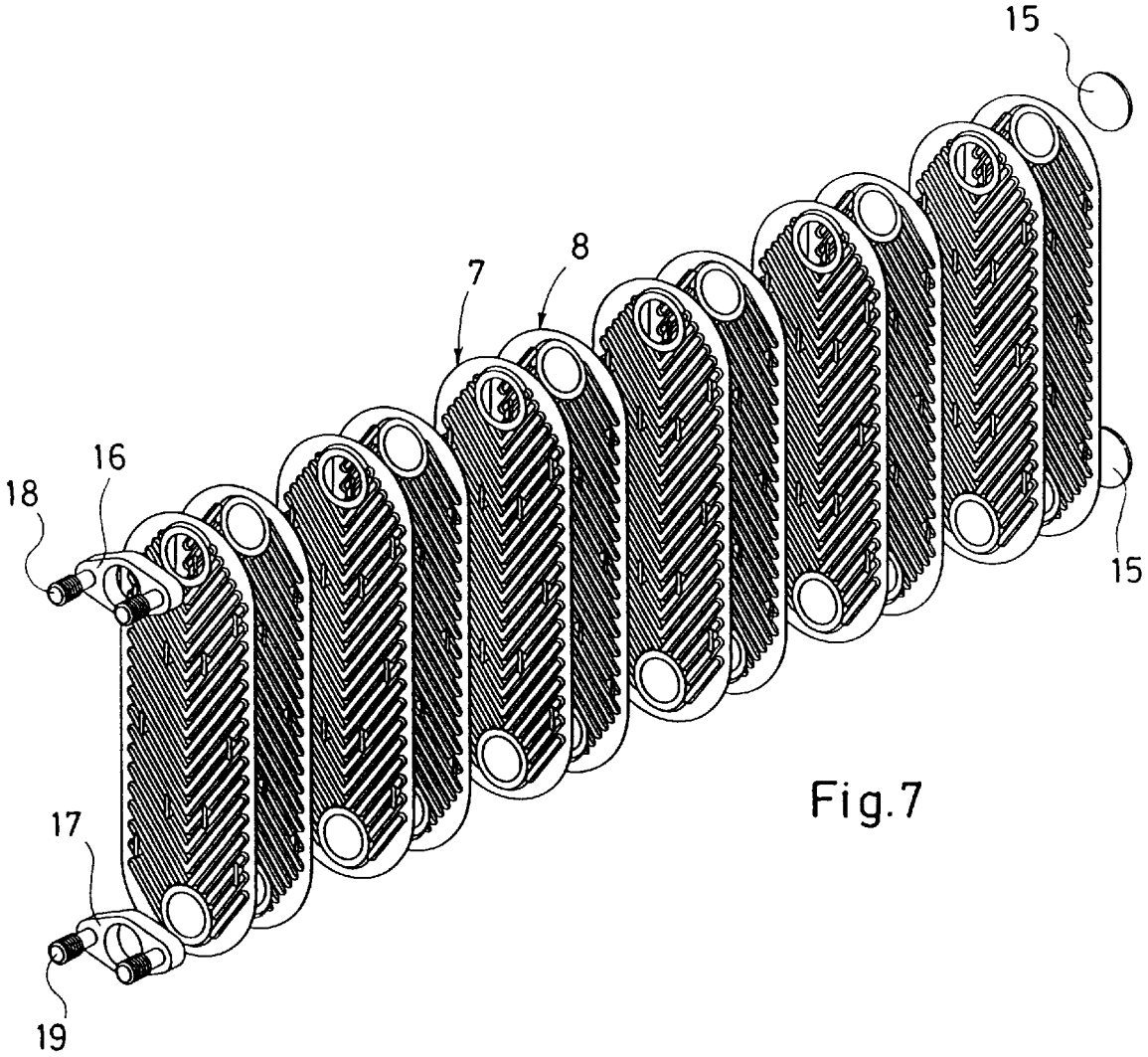
FIG. 7 shows the heat transfer plates at a plate heat exchanger according to FIG. 1 arranged at a distance from each other.

In practice all the plates that shall be a part of the heat exchanger will be piled at the manufacture of a plate heat exchanger according to the invention in the way illustrated in FIG. 7. Also the connecting pieces 16,17 and the washers 15 will be brought together with sufficient brazing material between those plates and other parts of the heat exchanger that will be brazed together. Thus in every cassette 6 the two plates in addition to along their edges will be brazed together, at all those places where the ridges 25 of the plates bear on each other in a crossing manner. Adjacent cassettes will be brazed together at their elevations 26 in addition to their annular areas 29–32.

From FIG. 4 those flow paths are evident which the cassettes 6 delimit within the plate heat exchanger for the oil and the water, respectively. The flow paths for the oil, created within the cassettes 6, are denoted by 33, while the flow paths for the water, created between the cassettes 6, are denoted by 34.

Figure 8:
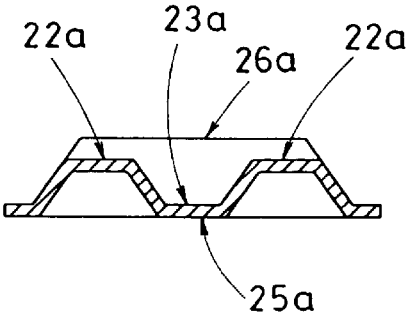
FIG. 8 shows a cross-section, alike FIG. 6*b* of a part of a heat transfer plate in an alternative embodiment.

As is evident from the FIG. 6*b* the ridges 22 on one side of a plate are broader than the ridges 25 on the other side of the plate. According to a preferred embodiment'of theinvention the press pattern on the plates is however such that the ridges on one side of a plate have the same form and size as the ridges on the other side of the plate. Hereby' an optimum area enlargement of the plate may be achieved at the pressing of its corrugation pattern. A plate which is pressed in this way is illustrated in FIG. 8, which shows a cross-section of the same kind as in FIG. 6*b*. FIG. 8 shows two ridges 22*a* on one side of a plate, one ridge 25*a* on the other side of the plate and an elevation 26*a* that extends between the tops of the ridges 22*a*, bridging a valley 23*a* between the ridges 22*a*. The elevation 26*a* is obviously somewhat higher than the ridges 22*a*.

At a plate heat exchanger according to the invention designed in accordance with what is described above the flow paths 34 for the water between the cassettes 6 achieve a larger flow area than the flow paths 33 for the oil within the cassettes. This is due to the fact that the elevations 26 keep the ridges 22 of adjacent cassettes 6 at a distance from each other.

By the fact that the plates in every cassette are brazed together at all those places where the ridges 25 bear on each other in a crossing manner the oil may be allowed to flow through the heat exchanger with a very high pressure without the need for holding the plates pressed together with the corresponding large forces. The water can accordingly be allowed to flow through the heat exchanger with a much lower pressure than the oil.

The cassettes need not be brazed together at their elevations 26 bearing on each other, since all the cassettes, including the uppermost and the lowermost cassette in FIG. 1, are so arranged as to be bypassed by water on both sides. To avoid vibrations for the cassettes during operation of the heat exchanger the cassettes are however conveniently held together in one way or another. As an alternative to brazing together of the cassettes via the elevations 26 the cassettes may be held pressed together against each other with the aid of a convenient mechanical device.

What is claimed:

1. A plate heat exchanger comprising a plurality of plates (7, 8) arranged so as to create plate interspaces (33,34) between adjacent plates for flow passages for two fluids, inlets (2, 4) and outlets (3, 5) for said fluids arranged so that a first one of the fluids can pass through every other plate interspace (33) and a second one of the fluids can pass through the remaining plate interspaces (34) in main directions of flow, which are in parallel with each other, each of said plates (7, 8) being provided with a press pattern arranged such that each side of each plate has ridges (22, 25) and valleys (23, 24) extending next to each other, forming an angle with said main directions of flow, said ridges (25) bearing on ridges (25) of an adjacent plate in a crossing manner in said every other plate interspace which is created for passing through of the first one of the fluids, every other plate having, on the side of said plate which is turned to a plate interspace (34) created for passing through of the second one of the fluids, elevations (26) created by pressing the plate, said elevations (26) being higher than the ridges (22) situated on the same side of the plate, and said elevations (26) at every other plate bearing on elevations of an adjacent plate in said plate interspace (34), created for passing through of the second one of the fluids such that opposite ridges (22) on the two adjacent plates are kept as a distance from each other, wherein all plates (7, 8) are provided with said elevations (26) in the plate interspaces (34) that are created for passing through of the second fluid and each one of the elevations (26) is elongated and extends with its longitudinal axis substantially in parallel with the main directions of flow, bridging at the most two valleys (23) between ridges (22) extending next to each other, said ridges being formed on the same side of the plate as the elevations (26).

2. The plate heat exchanger according to claim 1, wherein each one of the elevations (26) bridges only one valley (23) between two adjacent ridges (22).

3. The plate heat exchanger according to claim 1, wherein each elevation (26) on a plate bears on an elevation (26) on an adjacent plate.

4. The plate heat exchanger according to claim 1, wherein the plates (7, 8) are welded together with each other where the ridges (25) bear on each other in a crossing manner in the plate interspaces (33) for the first one of the fluids.

5. The plate heat exchanger according to claim 1, wherein the plates (7, 8) are elongated and extend with their longitudinal axes in parallel with the main directions of flow.

6. The plate heat exchanger according to claim 1, wherein the press pattern of the plates provides that the ridges (22*a*) on one side of a plate have substantially the same form and dimension as the ridges (25*a*) on the other side of the same plate.

7. The plate heat exchanger according to claim 1, wherein the plates (7, 8) in pairs form cassettes (6) and are welded together in every cassette partly along edge parts (27, 28) of the plates and partly where the ridges (25) of the plates bear on each other in a crossing manner.

8. The plate heat exchanger according to claim 7, wherein the cassettes (6) bear on and are brazed together with each other at the elevations (26).

* * * * *